US005282000A

United States Patent [19]

Miyake et al.

[11] Patent Number: 5,282,000

[45] Date of Patent: Jan. 25, 1994

[54] IMAGE PROCESSING APPARATUS HAVING AN ORIGINAL FEED DEVICE WITH TWO DENSITY DETECTORS

[75] Inventors: Norifumi Miyake; Takeshi Honjo, both of Kawasaki, Japan

[73] Assignee: Canon Kabushiki Kaisha, Tokyo, Japan

[21] Appl. No.: 664,612

[22] Filed: Mar. 4, 1991

[30] Foreign Application Priority Data

Mar. 5, 1990 [JP] Japan ..... 2-5643

[51] Int. Cl.[5] ..... G03G 21/00

[52] U.S. Cl. ..... 355/208; 355/246

[58] Field of Search ..... 355/208, 245, 246, 318-320, 355/69

[56] References Cited

U.S. PATENT DOCUMENTS

| | | | |
|---|---|---|---|
| Re. 32,330 | 1/1987 | Miyakawa et al. | 118/668 X |
| 4,200,391 | 4/1980 | Sakamoto et al. | 355/68 X |
| 4,737,856 | 4/1988 | Shimizu | 358/285 |
| 4,839,740 | 6/1989 | Yoshida | 358/288 |
| 4,982,232 | 1/1991 | Naito | 355/208 |
| 5,005,049 | 4/1991 | Matsushita | 355/208 |
| 5,134,438 | 7/1992 | Nakashima | 355/208 |

*Primary Examiner*—Lincoln Donovan
*Assistant Examiner*—Christopher Horgan
*Attorney, Agent, or Firm*—Fitzpatrick, Cella, Harper & Scinto

[57] ABSTRACT

An image processing apparatus includes an original feeder for feeding an original to an exposure position, a first detector provided in an original feed path of the original feeder for detecting a density of the original being fed, an exposure unit for exposing the original at the exposure position, a second detector provided at the exposure unit for detecting a density of the original at the exposure position, and a control unit for controlling processing conditions for an image on the original exposed by the exposure unit according to at least one output from the first detector and the second detector.

20 Claims, 13 Drawing Sheets

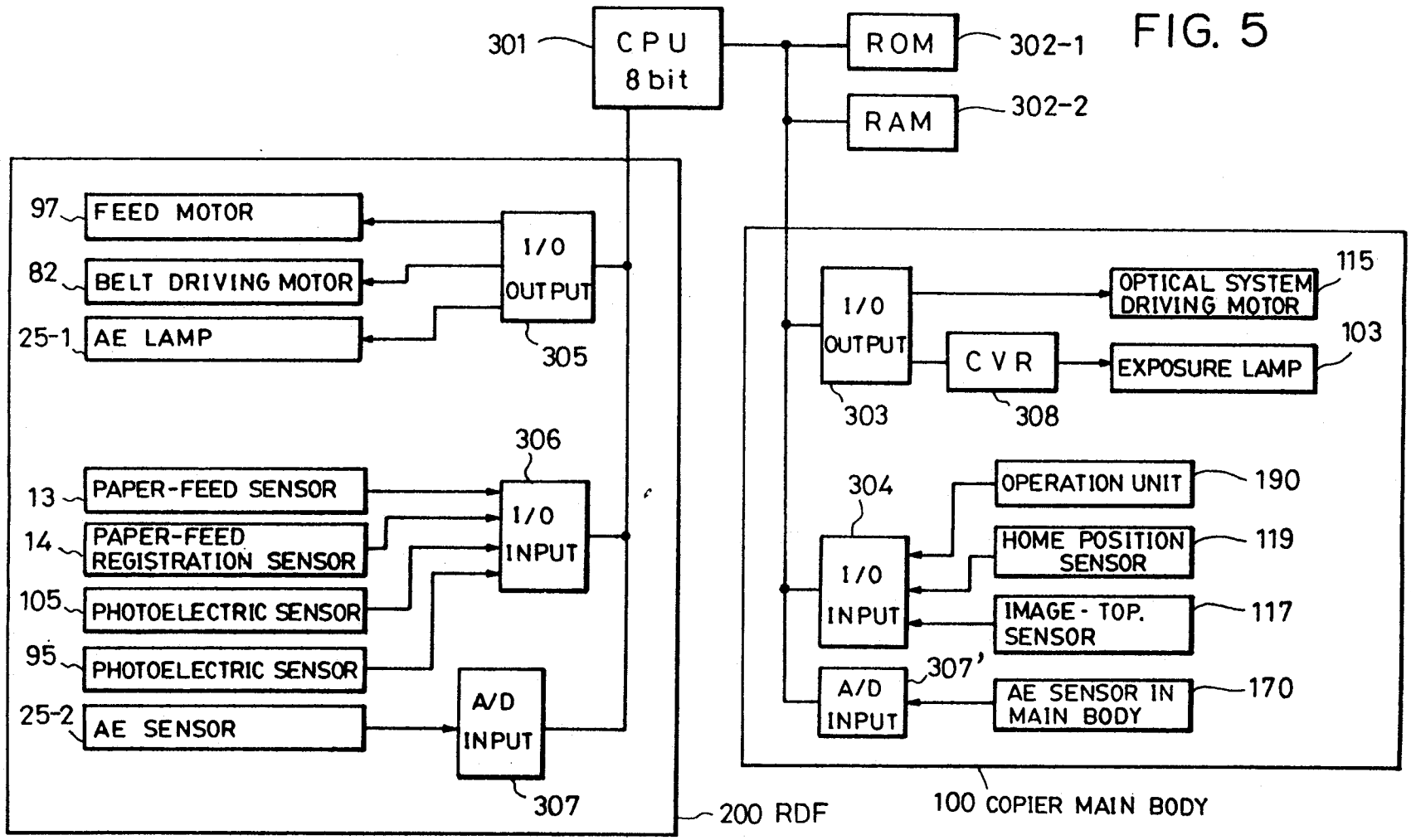
FIG. 5
ROM
302-1
RAM
302-2
CPU
8 bit
301
OPTICAL SYSTEM DRIVING MOTOR
115
EXPOSURE LAMP
103
C V R
308
I/O OUTPUT
303
OPERATION UNIT
190
HOME POSITION SENSOR
119
IMAGE - TOP. SENSOR
117
AE SENSOR IN MAIN BODY
170
I/O INPUT
304
A/D INPUT
307'
100 COPIER MAIN BODY
200 RDF
I/O OUTPUT
305
I/O INPUT
306
A/D INPUT
307
FEED MOTOR
97
BELT DRIVING MOTOR
82
AE LAMP
25-1
PAPER-FEED SENSOR
13
PAPER-FEED REGISTRATION SENSOR
14
PHOTOELECTRIC SENSOR
105
PHOTOELECTRIC SENSOR
95
AE SENSOR
25-2

IMAGE PROCESSING APPARATUS HAVING AN ORIGINAL FEED DEVICE WITH TWO DENSITY DETECTORS

BACKGROUND OF THE INVENTION

1. Field of the Invention

This invention relates to an image processing apparatus, such as an original reading apparatus, a copier, a facsimile apparatus or the like, having an original feed device.

2. Description of the Related Art

Heretofore, image processing apparatuses have been used which have an original feed function to feed an original onto a platen glass, and a so-called AE (automatic density adjustment) function to automatically detect the density of an image of the original and to adjust the density of a copy to a proper density by changing the amount of light of an exposure lamp in an optical scanning system. An image density detection means for the AE function in such an image processing apparatus is provided either in (i) an optical scanning system or in (ii) an original feed system.

In an apparatus (i) having an image density detection means for the AE function in an optical scanning system, after an original has been fed onto a platen glass and stopped, the original is prescanned by the optical scanning system to sample AE data, and the amount of light of an exposure lamp is determined according to the sampled AE data. Subsequently, scanning for image reading is performed in accordance with the amount of light of the exposure lamp determined.

In an apparatus (ii) having an image density detection means for the AE function in an original feed system, the image density detection means is disposed in an original feed path, and the density of an image of an original is detected while feeding the original.

However, the above-described conventional apparatuses having only one image density detection means for the AE function have, for example, the following disadvantages. In the apparatus (i) having the image density detection means for the AE function in the optical scanning system, in order to perform stable image density detection, prescanning of the optical scanning system for AE data to be sampled is needed before scanning (image scanning) for image reading. Hence, the number of operations for every original increases, and processing time is increased. As a result, the copying efficiency of the apparatus is substantially decreased particularly when performing image processing for a large number of originals, though the same holds true even for a single original.

In the apparatus (ii) having the image density detection means for the AE function in the original feed system, since the image density detection means is provided in an original feed unit, the AE function cannot be used when a copying operation is performed without using the original feed unit. Furthermore, the image density detection level becomes unstable due, for example, to stain by paper powder during a long period in the original feed operation. As a result, a proper amount of light of the exposure lamp cannot be obtained, and the AE function does not properly function.

SUMMARY OF THE INVENTION

It is an object of the present invention to provide an image processing apparatus in which the above-described disadvantages are removed.

It is a further object of the present invention to provide an image processing apparatus which provides a plurality of image density detectors, and which can efficiently perform image processing irrespective of the use of an original feed device.

It is a still further object of the present invention to provide an image processing apparatus which provides density detectors in both an original feeder and an original exposure device, and which can increase accuracy in density detection using the original feeder by correcting the output from the density detector in the original feeder according to the output from the density detector in the original exposure device without decreasing the image processing efficiency.

It is still another object of the present invention to provide an image processing apparatus which provides density detectors both in an original feeder and an original exposure device, and which can always perform stable density detection by correcting the output from the density detector in the original feeder according to the output from the density detector in the original exposure device, and performing density detection at the original exposure device side, while prohibiting density detection in the original feeder when a correction amount is equal to at least a predetermined value.

According to an aspect of the present invention, an image processing apparatus comprises an original feed unit having an original feed path for feeding an original to an exposure position. A first detector, provided in the original feed path, detects a density of the original being fed. An exposure unit exposes the original at the exposure position. A second detector, provided approximate to the exposure unit, detects the density of the original at the exposure position. A control means control processing conditions for an image of the original exposed by the exposure unit according to at least one output from the first detector and the second detector.

According to another aspect of the present invention, the correction means is provided for obtaining and storing correction data to correct output data from the first detector according to output data from the second detector. The control means controls processing conditions for an image of the original exposed by the exposure unit according to the correction data and the output data from the first detector.

According to still another aspect of the present invention, the control means controls processing conditions for an image of the original exposed by the exposure unit according to the correction data and the output data from the first detector when a value of the correction data obtained by the correction means is within a predetermined range. That control means also controls processing conditions for the image of the original exposed by the exposure unit according to the output data from the second detector when the value of the correction data obtained by the correction means is outside of the predetermined range.

According to still yet another aspect of the present invention, the control means controls processing conditions for an image of the original exposed by the exposure unit according to the correction data and the output data from the first detector, when a value of the correction data obtained by the correction means is within a predetermined range. The control means also prohibits exposure of the original mounted on the correction data obtained by the correction means is outside of the predetermined range.

These and other objects of the present invention will become more apparent from the following description taken in connection with the accompanying drawings and appended claims.

BRIEF DESCRIPTION OF THE DRAWINGS

FIG. 5 is a block diagram showing the circuit configuration of a control unit according to the first embodiment;

DETAILED DESCRIPTION OF THE PREFERRED EMBODIMENTS

Preferred embodiments of the present invention will now be explained in detail with reference to the drawings.

(1) Basic Configuration

Figure 1:
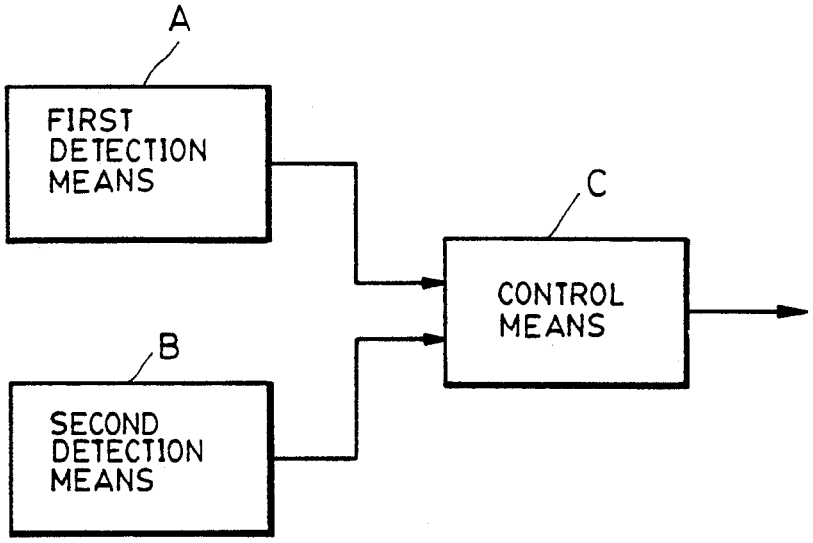
FIG. 1 is a block diagram showing the basic configuration of embodiments of the present invention.

FIG. 1 shows the basic configuration of the embodiments of the present invention. In FIG. 1, a first detection means A detects the density of an original fed by an original feed means while the original is being fed. A second detection means B detects the density of the original fed to an exposure position. A control means C properly sets the image processing conditions according to outputs from the first detection means A and the second detection means B.

The control means C properly sets image processing conditions according to an output from the second detection means B for a first original fed by the original feed means, obtains and stores a correction value for an output from the first detection means A according to outputs from the first detection means A and the second detection means B. The control means C properly sets image processing conditions in accordance with the above-described correction value and the output from the first detection means A for a second original.

(2) First Embodiment

FIGS. 2 through 8 show the first embodiment of the present invention.

The present embodiment is an example wherein the present invention is applied to an image recording apparatus having a recycle-type original (document) feeder (hereinafter termed an RDF).

A. Main Body 100

Copier main body 100 has an image reading function and an image recording function.

Figure 2:
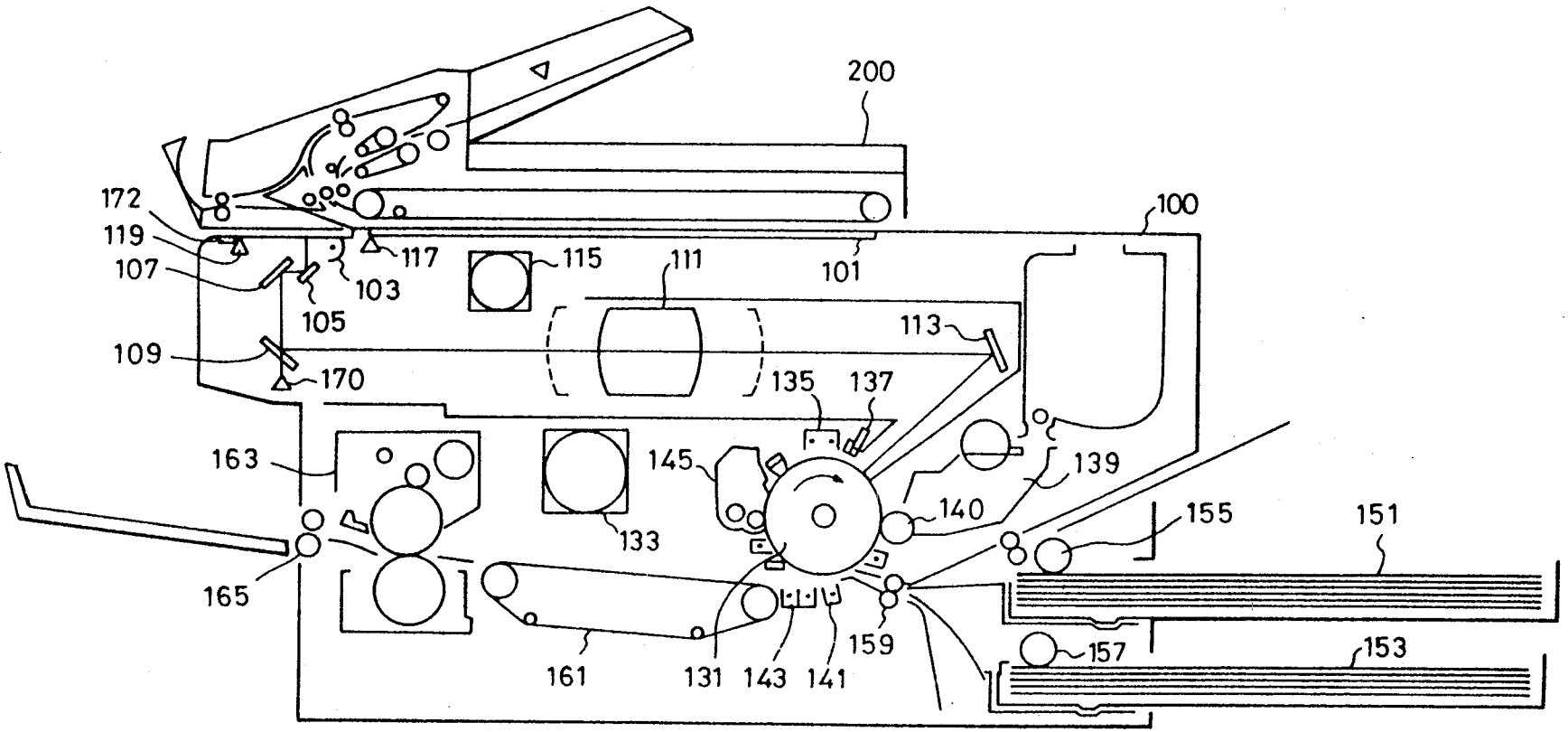
FIG. 2 is a cross-sectional view showing the internal configuration of an image processing apparatus according to a first embodiment of the present invention.

In FIG. 2, an original-mount glass 101 mounts an original. An exposure lamp 103 illuminates the original. Reflective mirrors (scanning mirrors) 105 and 107 deflect the optical path of light reflected by the original. A semi-transparent and semi-reflective mirror 109 deflects the optical path of the light reflected by the original, and transmits the light. There are also shown an original density detection means (AE sensor) 170 in the main body 100, and a white plate 172 for white level correction for the AE sensor 170. A lens 111 has a focusing function and a magnification varying function. A fourth reflective mirror (scanning mirror) 113 deflects the optical path. An optical system driving motor 115 drives the optical systems (103, 105, 107, 109 etc). An image top sensor 117 indicates the leading end of the image of the original. There is also shown a home position sensor 119 for the optical systems.

The main body 100 also includes a photosensitive drum 131, a main motor 133 for driving the photosensitive drum 131, a high-voltage unit 135, a blank exposure unit 137, a developing unit 139, a transfer charger 141, a charger 143 for separation, and a cleaning unit 145.

There are also shown an upper cassette 151, a lower cassette 153, paper feed rollers 155 and 157, and registration rollers 159. A feed belt 161 feeds a sheet on which the image of the original has been recorded to the side of a fixing unit 163. The fixing unit 163 fixes toner on the fed sheet by heating the toner while applying pressure.

The surface of the photosensitive drum 131 consists of a seamless photosensitive member comprising a photoconductor and a conductor. The photosensitive drum 131 is rotatably supported, and starts to rotate in the direction of arrow shown in FIG. 2 by the main motor 133 operating in response to the depression of a copy start key (to be described later).

After predetermined rotation control and potential control processing (preprocessing) for the photosensitive drum 131 has been completed, an original density detection operation (to be described later) in the main body is performed in an AE function selection mode. Subsequently, the original placed on the original-mount glass (platen glass) 101 is illuminated by a proper amount of light from the exposure lamp 103 provided as one body with the first scanning mirror 105. The light reflected by the original is imaged on the photosensitive drum 131 via the first scanning mirror 105, the second scanning mirror 107, the third scanning mirror 109, the lens 111 and the fourth scanning mirror 113.

The photosensitive drum 131 is subjected to corona charging by the high voltage unit 135. Subsequently, the image (the image of the original) illuminated by the exposure lamp 103 is subjected to slit exposure, and an electrostatic latent image is formed on the photosensitive drum 131.

Subsequently, the electrostatic latent image on the photosensitive drum 131 is developed by a developing roller 140 of the developing unit 139 to be visualized as a toner image, which is transferred to a sheet by the transfer charger 141, as will be described later.

That is, a sheet within the upper cassette 151 or the lower cassette 153 is transferred within the main body apparatus by the paper feed roller 155 or 157, respectively, and is transferred in the direction of the photosensitive drum 131 with an exact timing by the registration rollers 159 so that the front end of the latent image and the leading end of the sheet coincide with each other.

Subsequently, the sheet passes between the transfer charger 141 and the photosensitive drum 131, and the toner image on the photosensitive drum 131 is transferred to the sheet at that time.

After the completion of the transfer operation, the sheet is separated from the photosensitive drum 131 by the charger 143 for separation, is guided to the fixing unit 163 by the feed belt 161. The toner image on the sheet is fixed by pressure and heat in the fixing unit 163, and is then discharged outside the main body 100 by discharge rollers 165.

The photosensitive drum 131 after the transfer operation continues its rotation, and its surface is cleaned by the cleaning unit 145 comprising a cleaning roller and an elastic blade.

B. RDF 200

Figure 3:
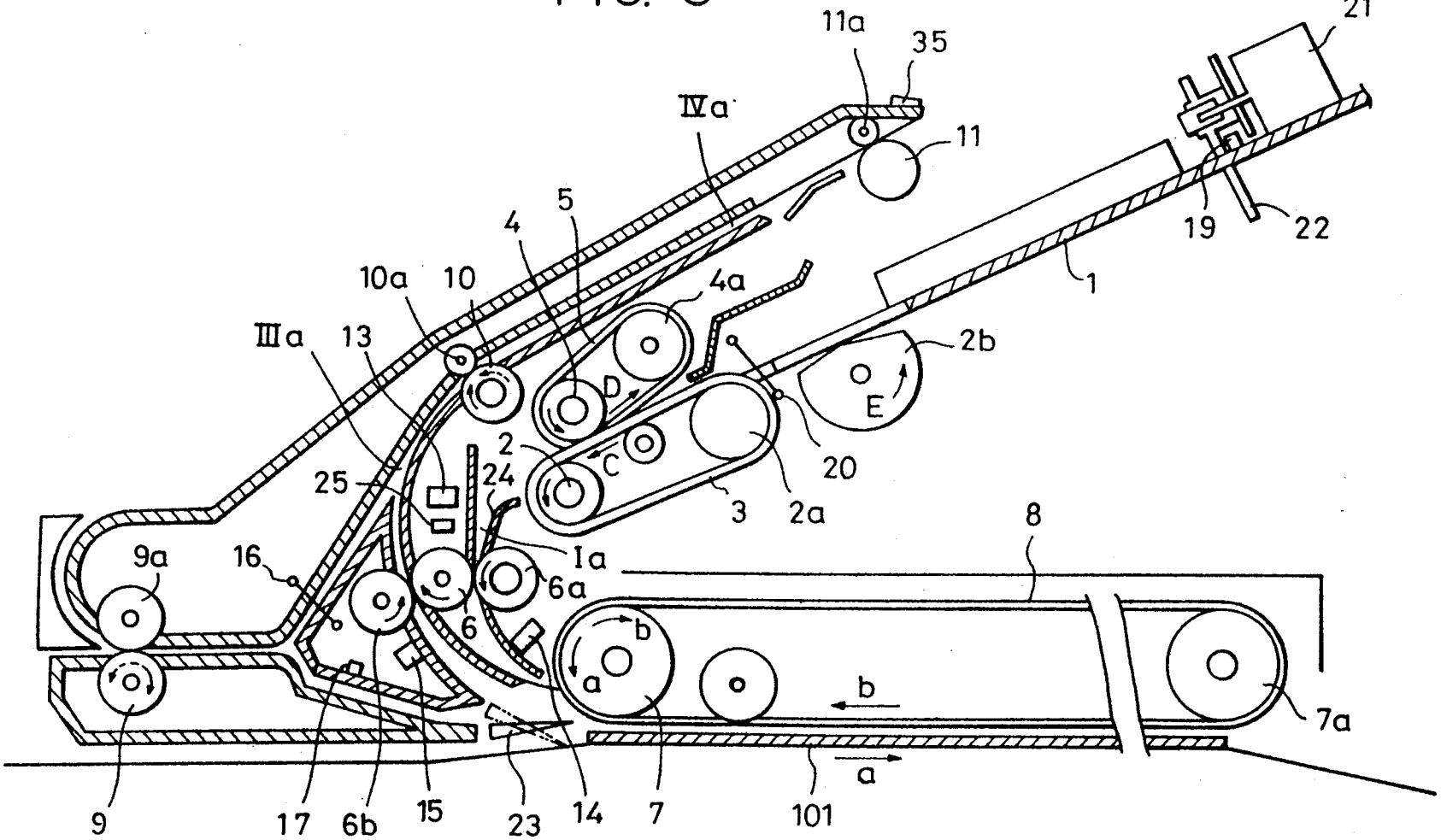
FIG. 3 is a cross-sectional view showing the schematic internal configuration of a recycle-type original (document) feeder (RDF) shown in FIG. 2.

FIG. 3 shows the schematic internal configuration of the RDF (recycle-type original (document) feeder) 200 shown in FIG. 2.

In FIG. 3, there is shown an original mount 1. A paper feed belt 3 is mounted between a feed-belt driving shaft 2 and a feed-belt driven shaft 2*a*, and is rotated in the direction of arrow C. A separation belt 5 is mounted between a separation-belt driving shaft 4 and a separation-belt driven shaft 4*a*, and is rotated in the direction of arrow D. A semicircular roller 2*b* rotates in the direction of arrow E. Plural sheets of originals mounted on the original mount 1 are separated one by one starting from the lowest sheet by the paper feed belt 3, the separation belt 5 and the semicircular roller 2*b*.

There are also shown a feed roller 6, rollers 6*a* and 6*b* in pressure contact with the feed roller 6. Also shown are feed rollers 9, 10 and 11, and rollers 9*a*, 10*a* and 11*a* in pressure contact with the feed rollers 9, 10 and 11, respectively.

A feed-belt driving roller 7 is situated near the left end of the platen glass 101 disposed on the upper face plate of the main body 100 of the copier. A feed-belt driven roller 7*a* is situated near the right end of the platen glass (the exposure surface) 101. A feed belt 8 is mounted between the above-described two rollers rotating in the direction of arrow "a" or in the direction of arrow "b".

The lower surface of the feed belt 8 very closely faces or contacts the upper surface of the platen glass 12.

Reflection-type sensors 15 and 17 are disposed at necessary portions in an original recycle path (paper path) in order to detect the leading end or rear end of the original. There are also shown a paper-feed sensor 13 and a paper-feed registration sensor 14.

A reflection-type photosensor (ES) 20 detects the original mounted on the original mount 1, and a recycle sensor (RS) 19 detects a recycle of the bundle of originals. A partition arm 22 is rotated and stopped on the bundle of originals by a recycle motor 21 to switch on the recycle sensor (RS) 19. Subsequently, originals are separated and fed starting from the lowest original. When the rear end of the final original has passed through the partition arm 22, the partition arm 22 passes the position of the recycle sensor (RS) 19 by its own weight to switch off the recycle sensor (RS) 19.

Figure 4:
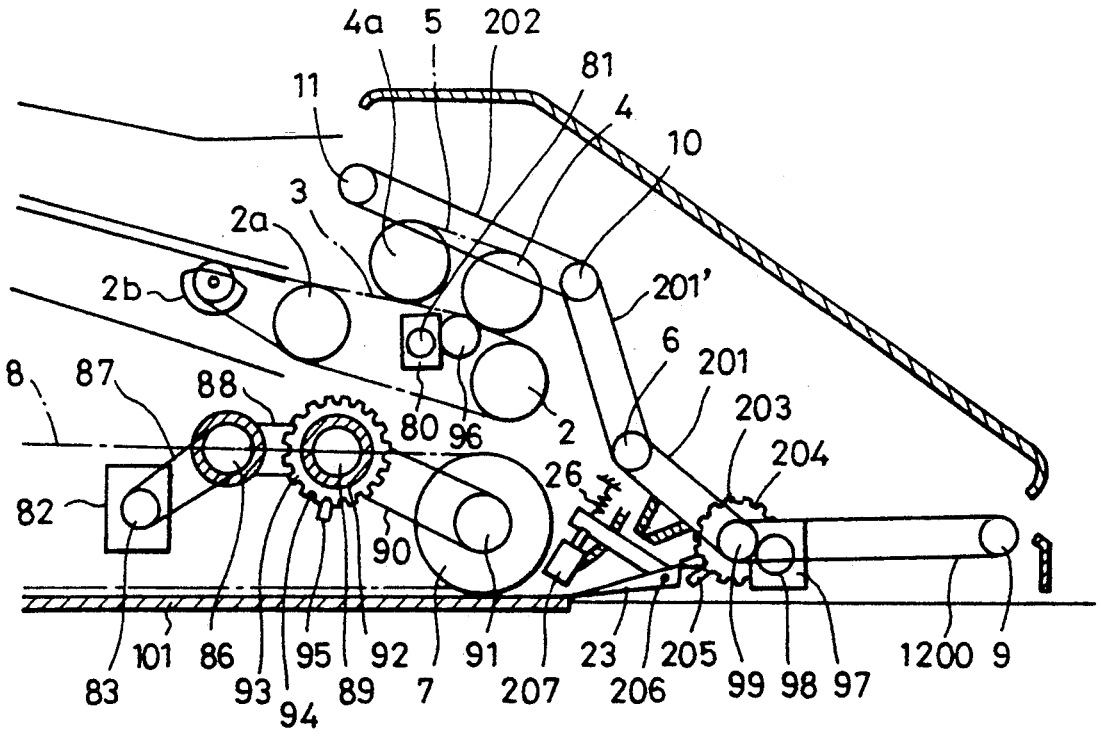
FIG. 4 is a cross-sectional view showing the configuration of the driving unit of the RDF shown in FIG. 3.

FIG. 4 shows a driving unit for the RDF 200. In FIG. 4, a motor gear 81 transmits the driving force of a motor (M2) 80 to the feed-belt driving shaft 2, the separation-belt driving shaft 4 and the semicircular roller 2*b* via a gear 96. A belt-drive motor (M1) 82, a motor pulley 83 and a two-stage pulley 86 transmit a driving force from a belt 87 to a belt 88. A two-stage pulley 89 provided as one body transmits the driving force from the belt 88 to a belt 90. Thus, the driving force is always transmitted to the driving roller 7 for the feed belt 8 via a pulley 91.

A disk 93 having notches 94 is rotated as one body with the two-stage pulley 89, and can detect the amount of movement of the belt 8 using a photoelectric sensor 95. An electromagnetic brake (BK) 92 can instantaneously stop the belt 8 by being switched on.

A feed motor (M3) 97, a gear 98, a pulley 99, and belts 1200, 201, 201' and 202 transmit a driving force to the feed rollers 6, 9, 10 and 11.

A disk 203 having notches 204 rotated as one body with the pulley 99 can detect the amount of rotation of the feed rollers 6, 9, 10 and 11, that is, the amount of feed of the original by the photoelectric sensor 205.

A switching pawl 23 is switched around a fulcrum 206 so as to feed the original on the platen glass 12 in the direction of the feed roller 6, or from the feed roller 9 in the direction of the platen glass 101 using a tension spring 26 and a solenoid (SL) 207.

Next, an explanation will be provided of the original feed operation by the RDF 200 when copying single-faced originals in an AE function selection mode.

In FIG. 3, plural sheets of single-faced originals are mounted on the original mount 1 in the descending order of pages placing the first page with its face up at the top of the originals.

The mounted originals are separated and are fed one by one starting from the lowest sheet by the paper-feed belt 3 and the separation belt 5. The fed sheet passes along paper path Ia, and is fed onto the platen glass 101 by the feed belt 8 with the image surface of the original facing down.

When the rear end of the original has been detected by the sensor (S2) 14, a count operation of the number of notches 94 of the disk 93 (FIG. 4) is started. After the count of a predetermined number, the motor (M1) 82 is switched off, and the electromagnetic brake (BK) 92 is switched on to instantaneously stop the rotation of the feed belt 8. The original is thereby automatically positioned at a predetermined position on the surface of the platen glass 101.

When the original has been thus positioned on the platen glass 101, a copying operation (including an AE operation in the main body) is started. After the completion of the copying operation, paper on which the image has been copied is received in a paper discharge tray. After the completion of exposure of the original, the solenoid (SL) 207 is switched on to place the switching pawl 23 in a state shown by broken lines. The exposed original is discharged through paper paths IIIa and IVa. At the same time, the next original is fed in parallel according to the above-described operation, and is positioned and set on the platen glass 101.

Since this parallel operation is only an operation to recycle the original, and both the preceding and succeeding originals are not reversed during the operation, the operation is termed a normal discharge and normal feed operation.

If a sheet sorting device (hereinafter termed a sorter) capable of sorting paper (copy sheets) on which images have been copied is connected to the main body 100 of the system, the copying operation for the set number of sheets is performed for every original. After the completion of the copying operation, the normal discharge and normal feed operation is performed, and the copying operation for the remaining originals is performed. If there is no sorter and it is therefore impossible to sort paper on which images have been copied, the normal discharge and normal feed operation is sequentially performed. A recycle of the set original is detected by the recycle sensor (RS) 19, the end of the recycle is notified to the main body 100 of the copier, and the number of sheets on which images have been copied is counted. The above-described operation is repeated until the number of sheets reaches the set number, and copies of the necessary number are received in the paper-discharge tray of the copier.

The above-described RDF 200 has a recycle function for double-faced originals, but an explanation of the function will be omitted since the function is not directly related with the objects of the present invention.

C. Control unit 300

Figure 6:
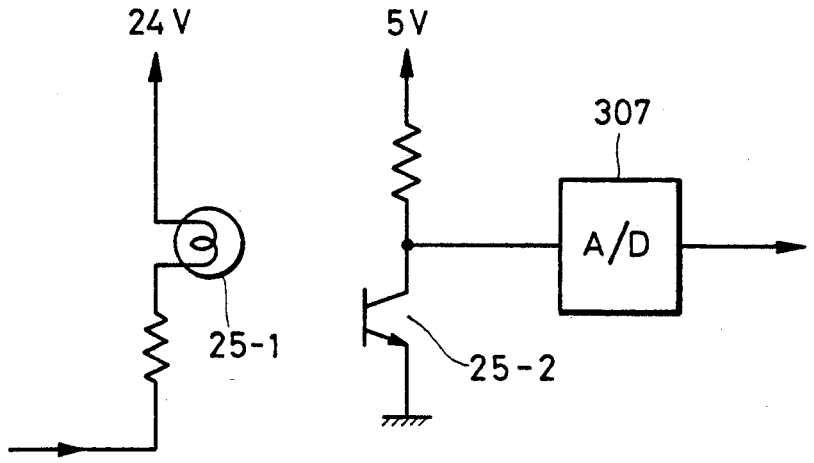
FIG. 6 is a circuit diagram showing an example of the configuration of the AE lamp and AE sensor shown in FIG. 5.

FIG. 5 shows the circuit configuration of a control unit 300. In FIG. 5, like components as in FIGS. 2 through 4 are indicated by like numerals. In FIG. 5, an AE lamp 25-1 serving as a light source for AE, and an AE sensor (a reflection-type sensor) 25-2 are provided outside the feed path Ia. The AE lamp 25-1 and the AE sensor 25-2 constitute an original density detection means 26 in the RDF 200. Light issued from the AE lamp 25-1 is reflected by the original being fed, and is sensed by the AE sensor 25-2. The density of the original being fed along the feed path is thereby detected. FIG. 6 specifically illustrates the detection means. In FIG. 6, an A/D (analog-to-digital) converter 307 digitizes the output from the AE sensor (a phototransistor) 25-2.

A standard white plate 24 shown in FIG. 3 faces the AE sensor 25-2, and corrects the white level of the AE sensor 25-2.

In FIG. 5, the above-described AE sensor 170 in the main body 100 is provided on the extension of the optical axis toward the semi-transparent and semi-reflective mirror 109 (see FIG. 2). The exposure lamp 103 and the AE sensor 170 constitute the original-density detection means in the main body 100. In an AE operation in the main body, scanning for AE is performed by the exposure lamp 103, and the density of the original is detected by comparing the output level of the AE sensor 170 for the white plate 172 in the main body with the output level of the AE sensor 170 for the original on the platen glass 101.

A central processing unit (CPU) 301, such as a microcomputer μCOM87AD made by NEC Corporation, serving as an exposure amount calculation means, calculates a proper amount of exposure according to the density of the original detected by the original-density detection means. The CPU 301 also corrects the level of the original-density sensor.

Figure 7A:
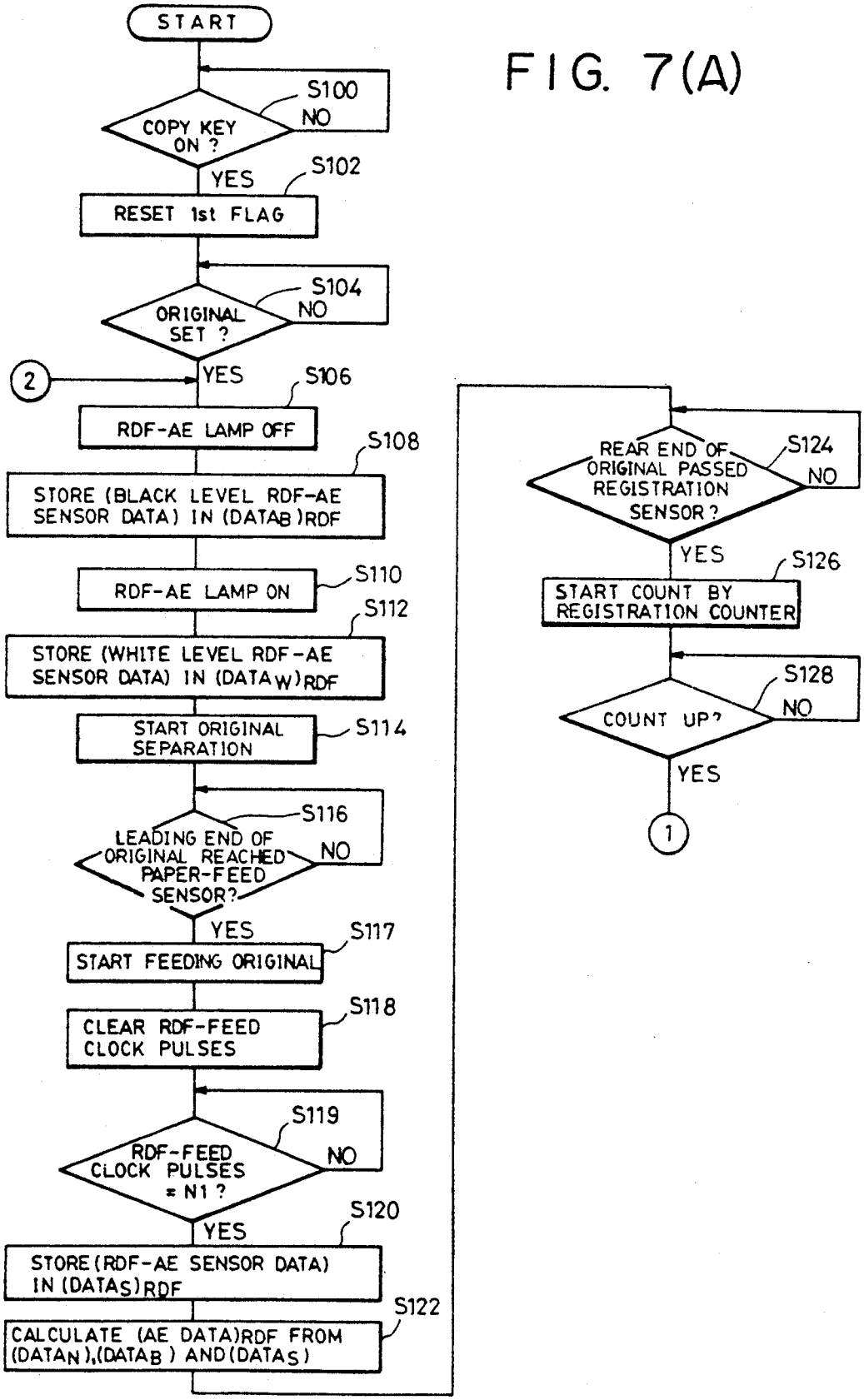
FIGS. 7(A), 7(B), and FIG. 8 are flowcharts showing a control procedure (control program) of the first embodiment stored in the control unit shown in FIG. 5.
Figure 7B:
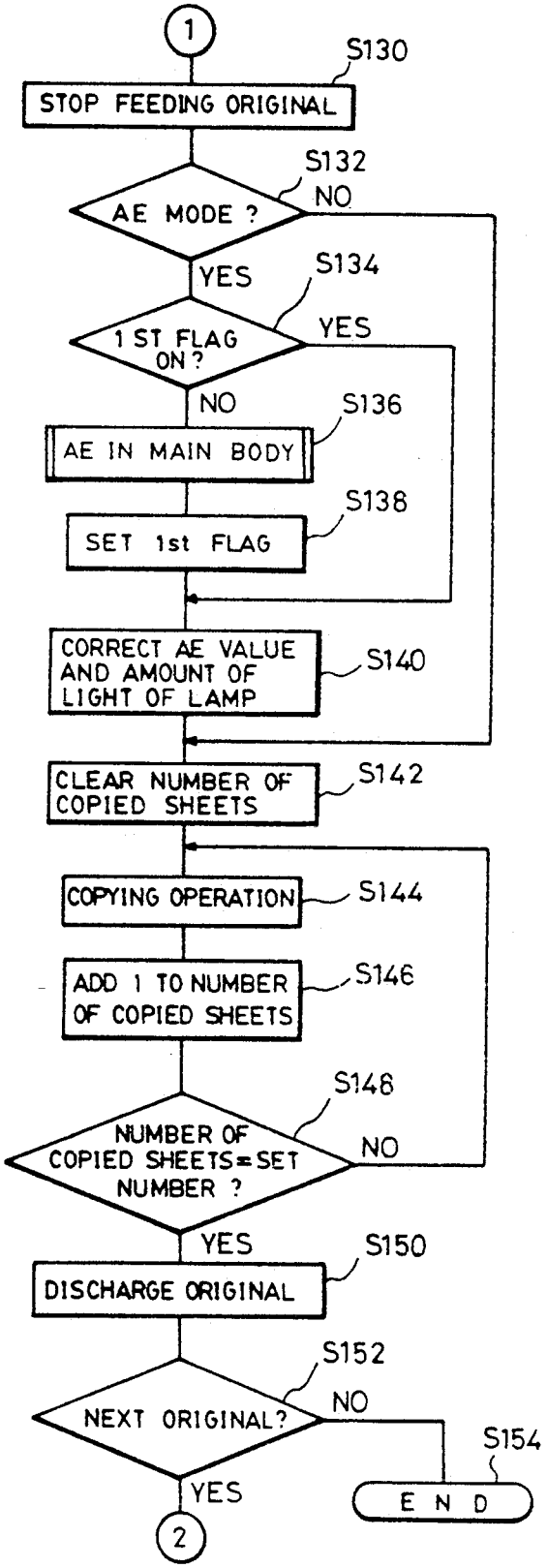
Figure 8:
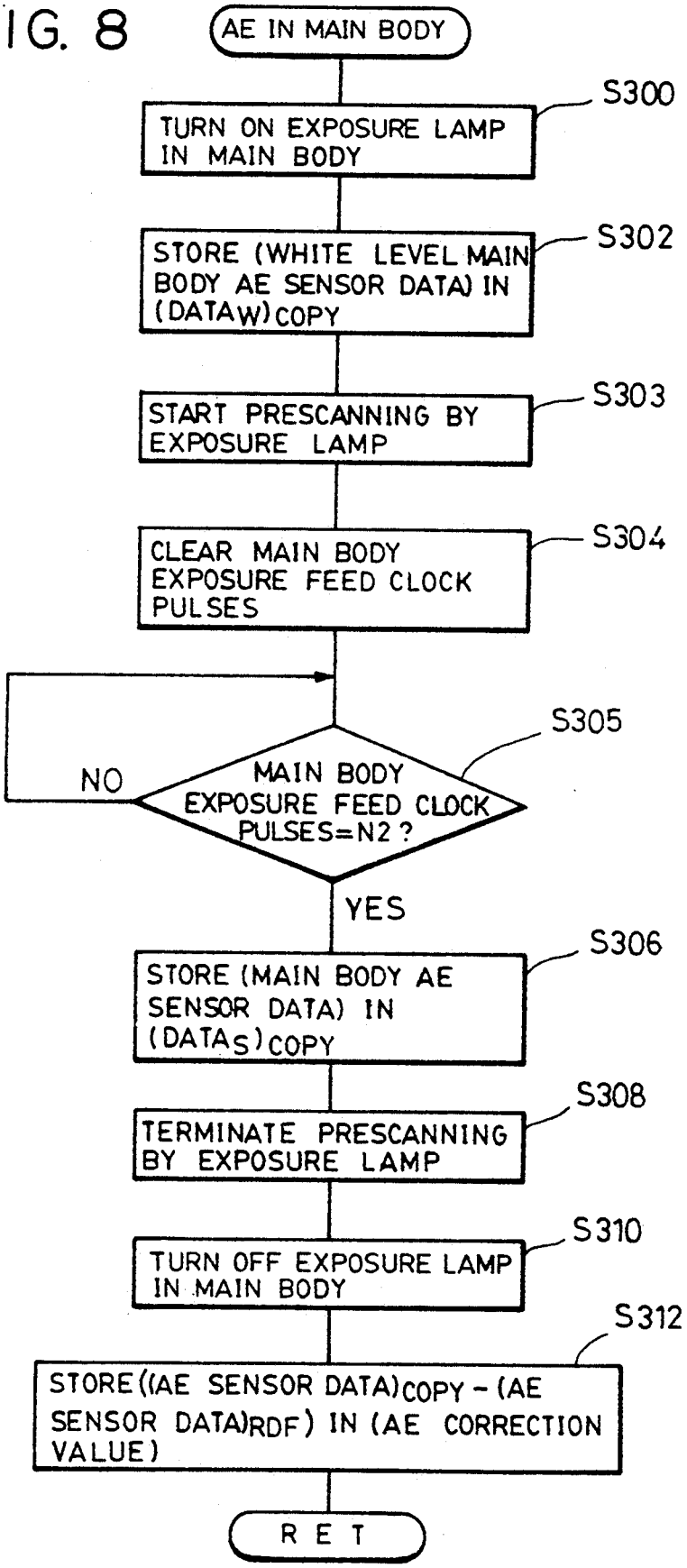

A read-only memory (ROM) 302-1 has previously stored the control procedure (control program) according to the present invention as shown in FIGS. 7(A), 7(B) and 8. The CPU 301 controls respective components connected thereto via a bus in accordance with the control procedure stored in the ROM 302-1. A random access memory (RAM) 302-2 is used for the storage of input data, and as storage areas for operations, and the like.

An interface (I/O) 303 is a circuit for outputting control signals from the CPU 301 to loads, such as the optical system driving motor 115 and the like. Another interface 304 is a circuit for inputting signals from the operation unit 190, home position sensor 19, image sensor 117 and the like, and transmitting the signals to the CPU 301. An interface 305 is connected to loads, such as the feed motor 97 for the RDF 200, belt driving motor 82, AE lamp 25-1 and the like. An interface 306 is connected to the paper-feed sensor 13, paper feed registration sensor 14, photoelectric sensors 95, 105 and the like.

An A/D converter 307' converts analog data from the AE sensor 170 in the main body into digital data, and transmits the converted data to the CPU 301. A CVR 308, which constitutes a light-amount correction means together with the CPU 301, is a circuit for correcting the amount of light of the exposure lamp 103 according to the proper amount of exposure calculated by the CPU 301 until the original is fed and positioned on the platen glass 101. An A/D converter 307 converts analog data from AE sensor 25-2 into digital data, and transmits the converted data to the CPU 301.

D. Example of Operation

FIGS. 7(A) and 7(B) show a control procedure according to the embodiment which is stored in the ROM 302-1 and is executed by the CPU 301.

First, at step S100, the CPU 301 determines whether or not a copy start key (not shown) on the operation unit has been depressed. If the CPU 301 has determined that the copy start key was depressed at step S100, the CPU 301 which controls the operation of respective components initializes (resets) a flag (assumed a 1st flag) provided on a predetermined area on the RAM 302-2.

Next, at step S104, the CPU 301 checks whether or not the bundle of originals has been set on the original tray 1 on the RDF 200 according to an output from the sensor 20. If the result is affirmative, initial data collection by the AE sensor 25-2 in the RDF 200 from the next step S106 until step S112 is performed. That is, at step S106, the AE lamp 25-1 is turned off. At step S108, output data (RDF-AE sensor data) from the RDF-AE sensor 25-2 at that time are stored in data area $(DATA_B)_{RDF}$ in the RAM 302-2. The stored data serve as data for the black level. Subsequently, at step S110, the RDF-AE lamp 25-1 is turned on. At step S112, AE sensor data at that time are stored in another data area $(DATA_W)_{RDF}$ in the RAM 302-2. At that time, by reading the white plate 24 facing the RDF-AE sensor 25-2, data for the white level are stored in the $(DATA_W)_{RDF}$.

Next, at step S114, the separation operation of originals is started by driving the paper-feed belt 3 and the like, wherein originals are separated one by one starting from the lowest original. When the leading end of the original has reached the paper-feed sensor 13 at step S116, the feed operation of the original is started at step S117.

At the next step S118, a counter in the RAM 302-2 for counting clock pulses (RDF feed clock pulses) synchronizing with the feed of the original are cleared, and a counting operation is started. After counting a predetermined number (N1) of clock pulses (S119), the RDF-AE lamp 25-1 is turned on. At step S120, data of the RDF-AE sensor 25-2 at that time, that is, RDF-AE sensor data corresponding to the density of the original, are stored in data area $(DATA_S)_{RDF}$ in the RAM 302-2. It is thereby possible to measure the AE sensor data (RDF-AE sensor data) at a predetermined distance from the leading end of the original using the number of the RDF feed clock pulses and the feed distance per clock pulse.

Although only one point is sampled in the present embodiment, it is possible to increase accuracy by sampling a plurality of points and calculating the average value of the points.

Subsequently, at step S122, (AE data)$_{RDF}$ is calculated using respective data (DATA$_W$)$_{RDF}$, (DATA$_B$)$_{RDF}$ and (DATA$_S$)$_{RDF}$ sequentially stored in the RAM 302-2. If, for example, (DATA$_S$)$_{RDF}$=2.5 V when (DATA$_W$)$_{RDF}$=1.0 V and (DATA$_B$)$_{RDF}$=4.2 V, the density is (2.5−1.0)/(4.2−1.0)=47%, Subsequently, after waiting until the rear end of the original passes through the paper-feed registration sensor 14 at step S124, a counting operation by the registration counter is started at step S126. After counting belt clock pulses by the registration counter and waiting until the count value reaches a predetermined value at step S128, the feed of the original is stopped at step S130, and the original is stopped at a predetermined position on the platen glass 101.

Subsequently, at step S132, the CPU 301 determines whether or not the set image forming mode is a so-called AE mode wherein the density of the original is detected and proper exposure is performed in accordance with the detected density. If the result of determination is negative, the process proceeds to step S142, which will be described later.

If the result of determination is affirmative, the CPU 301 determines whether or not the above-described flag (1st flag) in the RAM 302-2 has been set. If the result of determination is affirmative, the process proceeds to step S140. If the result of determination is negative, processing of AE in the main body (to be described in detail with reference to FIG. 8) is performed at step S136.

Subsequently, at step S138, the 1st flag is set, and the process proceeds to step S140. At step S140, the correction of the proper AE value and the correction of the amount of light of the exposure lamp are performed using the AE value measured in the RDF 200 and the AE value measured in main body 100.

At step S142, the number of sheets on which images have been copied is cleared. At step S144, a copying operation is performed. After a one-cycle copying operation has been completed, the number of sheets on which images have been copied is incremented by 1 at step S146. At step S148, the CPU 301 determines whether or not the number of sheets on which images have been copied is equal to a preset number. If the result of determination is negative, the process proceeds to step S144. If the result of determination is affirmative, the original is discharged at step S150. Subsequently, at step S152, the presence of the next original is determined. If the next original is present, the process proceeds to step S106, where the same processing as described above is performed. If the next original is absent, the process is terminated at step S154.

Next, an explanation will be provided of a detailed control procedure of the operation control of AE in the main body in the present embodiment described at step S136 of FIG. 7 with reference to the flowchart shown in FIG. 8.

In AE in the main body, first at step S300, the exposure lamp 103 to be used for the density measurement is turned on to perform exposure on the white plate 172. At step S302, white-level main-body AE sensor data are read by the AE sensor 170 in the main body using light reflected by the white plate 172, and the data are stored in data area (DATA$_W$)$_{COPY}$ in the RAM 302-2 as white-level data.

Subsequently, at step S303, in order to detect the density of the original, prescanning by the exposure lamp 103 in the main body is started. At step S304, a counter in the RAM 302-2 for counting clock pulses (main-body exposure feed clock pulses) synchronized with the movement of the exposure unit is cleared, and a counting operation is started. After counting a predetermined number (N2) of clock pulses at step S305, the density of the original is detected, and detected data are stored in data area (DATA$_S$)$_{COPY}$ in the RAM 302-2 as main-body AE sensor data at step S306. At that time, by operating the above-described values N1 and N2 at step S119 of FIG. 7, and the like, it is possible to measure AE sensor data for an identical area on the original both in the RDF and in the main body.

Compared with the AE sensor data obtained from the AE sensor 25-2 in the RDF 200, it can be said that the main-body AE sensor data obtained according to the above-described procedure are stable and reliable AE sensor data because no change in the AE level due to stain by paper powder is present, and the AE sensor data are measured from the original being stopped. The amount of exposure for the first original is set according to the above-described main-body AE sensor data.

The process then proceeds to step S308, where the prescanning by the exposure lamp 103 for AE in the main body is terminated. At step S310, the exposure lamp 103 in the main body is turned off. Subsequently, at step S312, the difference between the main-body AE sensor data and the RDF-AE sensor data is calculated, and the difference value is stored in area (AE correction value) in the RAM 302-2 as the correction value for the RDF-AE sensor data.

It becomes possible to correct the AE sensor level in the RDF 200 using the data in this area (AE correction value) (see step S140 of FIG. 7).

As described above, in the present embodiment, in a series of copying operations (copying jobs) performed in accordance with a depressing operation of the copy start key, when using the RDF 200, original-density detection in both the RDF 200 and the main body 100 (see steps S108, S112 and S136) is performed only during the first feed of the first original being fed onto the platen glass 101, and the difference value between two detection values is stored in the RAM 302-2 as a correction value (see step S312). During the feed of the original after the next fed original, original-density detection is performed only in the RDF 200 (see steps S102, S134 and S138). An exact original-density value for the original can be estimated from the density of the original detected in the RDF 200 and the above-described correction value without performing an original-density detection operation in the main body 100 (see step S140).

Thus, since a change in the original-density detection value due to stain by paper powder and the like during a long period in the RDF 200 is corrected by the correction value obtained from the first original, it becomes possible to perform superior original-density detection. Furthermore, since only one original-density detection operation for the first original in the main body 100 is needed, the time required for the detection operation is minimized, and it is therefore possible to expect a great increase in the image processing efficiency.

If a copying operation is performed by manually placing the original on the platen glass without using the RDF 200, the density of the original is detected by the AE sensor 170 in the main body in an AE mode.

As an alternative to controlling the amount of light of the exposure lamp, biasing voltage for development may be controlled.

(3) Second Embodiment

Figure 9:
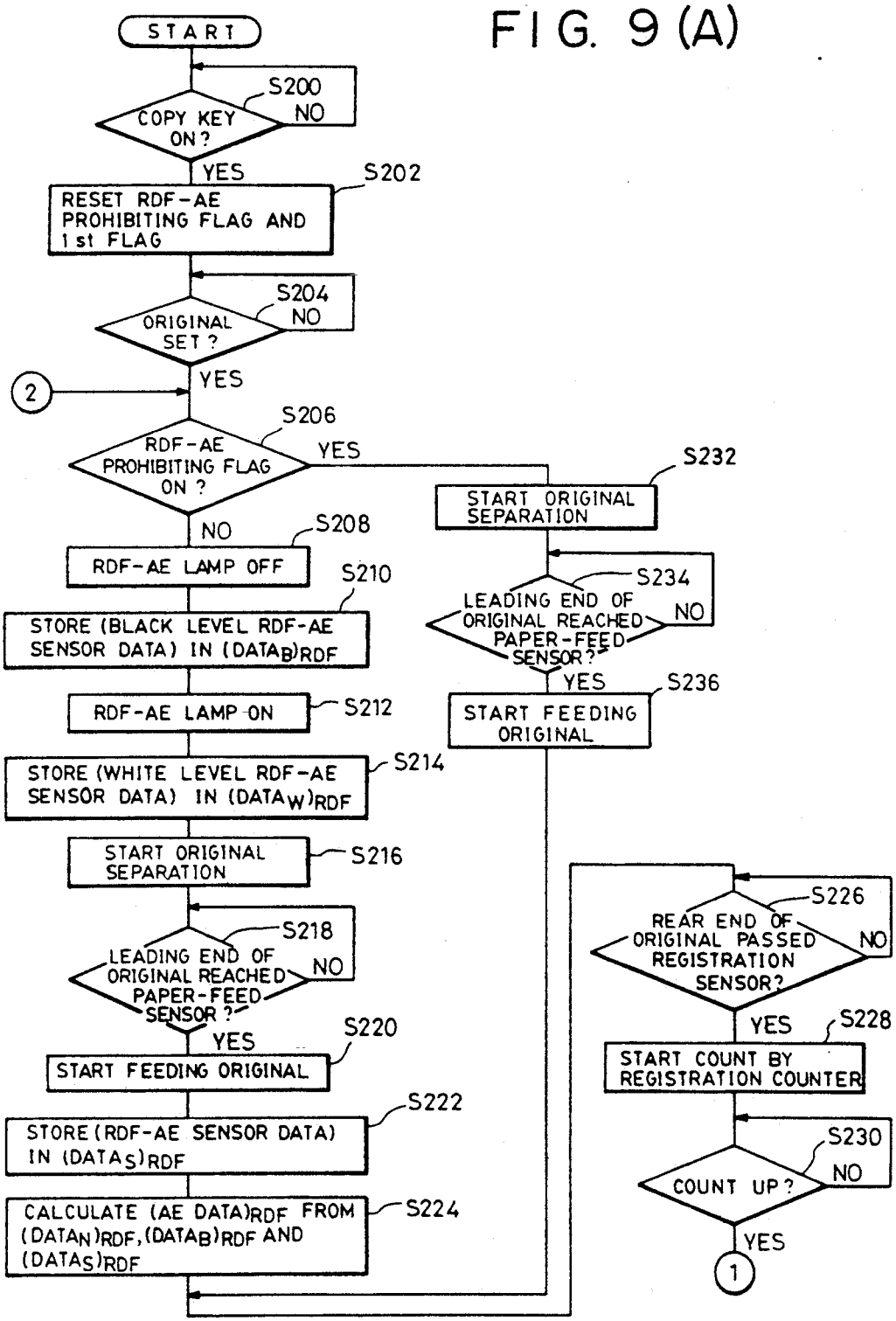
FIGS. 9(A) and 9(B) are flowcharts showing the operation of a second embodiment of the present invention.
Figure 9B:
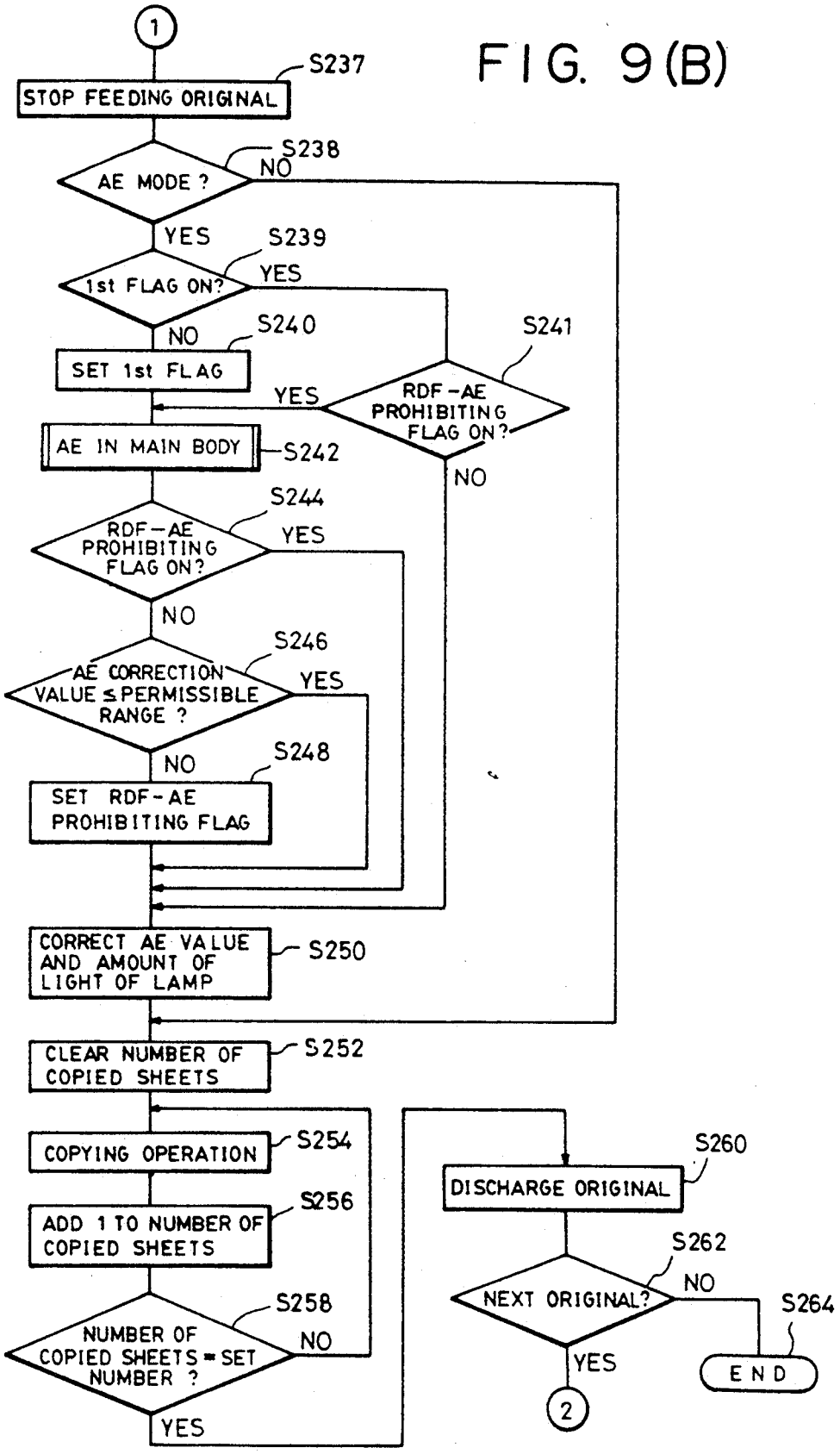

The flowcharts of FIGS. 9(A) and 9(B) show a control procedure in another (second) embodiment of the present invention.

The present embodiment is an example wherein the present invention is applied to an image recording apparatus including a recycle-type original (document) feeder (RDF). The basic configuration of the apparatus is identical to that of the first embodiment.

The control operation of the second embodiment will now be explained with reference to FIGS. 9(A) and 9(B).

First, at step S200, the CPU 301 determines whether or not the copy start key on the operation unit has been depressed. If the CPU 301 has determined that the copy start key was depressed at step S200, at the next step S202, the CPU 301 for controlling the operation of respective components initializes (resets) the RDF-AE prohibiting flag and 1st flag provided in the RAM 302-2.

Next, at step S204, the CPU 301 checks whether or not the bundle of originals has been set on the original tray 1 on the RDF 200 according to an output from the sensor 20. If the result of check is affirmative, the CPU 301 determines whether or not the RDF-AE prohibiting flag has been set. If the result of determination is affirmative, the process proceeds to step S232, which will be described later. If the result is negative, initial data collection by the RDF-AE sensor 25-2 from the next step S208 until step S214 is performed. That is, at step S208, the AE lamp 25-1 is turned off. At step S210, output data (RDF-AE sensor data) from the RDF-AE sensor 25-2 at that time are stored in data area $(DATA_B)_{RDF}$ in the RAM 302-2. The stored data serve as data for the black level. Subsequently, at step S212, the RDF-AE lamp 25-1 is turned on. At step S214, AE sensor data at that time are stored in data area $(DATA_W)_{RDF}$ in the RAM 302-2. At that time, by reading the white plate 24 facing the RDF-AE sensor 25-2, data for the white level are stored in the $(DATA_W)_{RDF}$.

Next, at step S216, the separation operation of originals is started by driving the paper-feed belt 3 and the like, wherein originals are separated one by one starting from the lowest original. When the leading end of the original has reached the paper-feed sensor 13 at step S218, the feed operation of the original is started at step S220.

At the same time, the RDF-AE lamp 25-1 is turned on. At step S222, data of the RDF-AE sensor 25-2 at that time, that is, RDF-AE sensor data corresponding to the density of the original, are stored in data area $(DATA_S)_{RDF}$ in the RAM 302-2. Although only one point is sampled in the present embodiment, it is possible to increase accuracy by sampling a plurality of points and calculating the average value of the points.

Subsequently, at step S224, (AE data)$_{RDF}$ is calculated using respective data $(DATA_W)_{RDF}$, $(DATA_B)_{RDF}$ and $(DATA_S)_{RDF}$ sequentially stored in the RAM 302-2. If, for example, $(DATA_S)_{RDF}=2.5$ V when $(DATA_W)_{RDF}=1.0$ V and $(DATA_B)_{RDF}=4.2$ V, the density is $(2.5-1.0)/(4.2-1.0)=47\%$.

Subsequently, after waiting until the rear end of the original passes through the paper-feed registration sensor 14 at step S226, a counting operation by the registration counter is started at step S228. After counting belt clock pulses by the registration counter and waiting until the count value reaches a predetermined value at step S230, the feed of the original is stopped at step S237, and the original is stopped at a predetermined position on the platen glass 101.

Subsequently, at step S238, the CPU 301 determines whether or not an AE mode has been set. If the result of determination is negative, the process proceeds to step S252, which will be described later.

If the result of determination is affirmative, the process proceeds to step S239. If the 1st flag is turned off, the 1st flag is set at step S240, and processing of AE in the main body is performed at step S242. The processing of AE in the main body at step S242 is performed in the same manner as the processing in the first embodiment shown in FIG. 8.

If the 1st flag has been turned on at step S239, the process proceeds to step S241, from where the process proceeds to step S252 or step S242 if the RDF-AE prohibiting flag is turned off or on, respectively.

Subsequently, at step S244, the CPU 301 determines whether or not the above-described flag (RDF-AE prohibiting flag) in the RAM 302-2 has been set. If the result of determination is affirmative, the process proceeds to step S250. If the result of determination is negative, the CPU 301 determines whether or not the AE correction value calculated at step S242 is within a preset permissible range at step S246. If the result of determination is negative, the flag (RDF-AE prohibiting flag) in the RAM 302-2 is set at step S248. Subsequently, at step S250, the correction of the proper AE value and the correction of the proper amount of light of the lamp are performed using three kinds of information: the RDF-AE value, the main-body AE value and the RDF-AE prohibiting flag.

At step S252, the number of sheets on which images have been copied is cleared. At step S254, a one-cycle copying operation is performed. Subsequently, the number of sheets on which images have been copied is incremented by 1 at step S256. At step S258, the CPU 301 determines whether or not the number of sheets on which images have been copied is equal to a preset number. If the result of determination is negative, the process proceeds to step S254. If the result of determination is affirmative, the original is discharged at step S260. Subsequently, at step S262, the presence of the next original is determined. If the next original is present, the process proceeds to step S206, where the same processing as described above is performed. If the next original is absent, the process is terminated at step S264.

As described above, in the present embodiment, in a series of copying operations (copying jobs) performed in accordance with a depressing operation of the copy start key, when using the RDF 200, original-density detection in both the RDF 200 and the main body 100 is performed only during the first feed of the first original being fed onto the platen glass 101, and the difference value between two detection values is stored in the RAM 302-2 as a correction value. If the correction value is within a predetermined permissible range, during the feed of the original after the next, original-density detection is performed only in the RDF 200. An exact original-density value for the original can be estimated from the density of the original detected in the RDF 200 and the above-described correction value without performing an original-density detection operation in the main body 100. If the correction value exceeds the permissible range, the use of the RDF-AE sensor is prohibited, and density detection for all originals is performed in the main body 100.

Thus, the CPU 301 determines whether or not the AE sensor output, which is apt to change due to stain by paper powder and the like during a long period in the RDF 200, is correctable. If the result of determination is affirmative, the amount of light of the exposure lamp is determined from the correction value and the RDF-AE value. If the result of determination is negative, automatic adjustment (AE) of the density of the original is performed by the AE sensor in the main body. Hence, even if the use of the RDF-AE sensor is prohibited, it is possible to always perform proper automatic density adjustment for the density of the original.

As in the first embodiment, when performing a copying operation without using the RDF 200, density detection is performed in the main body 100.

(4) Third Embodiment

Figure 10:
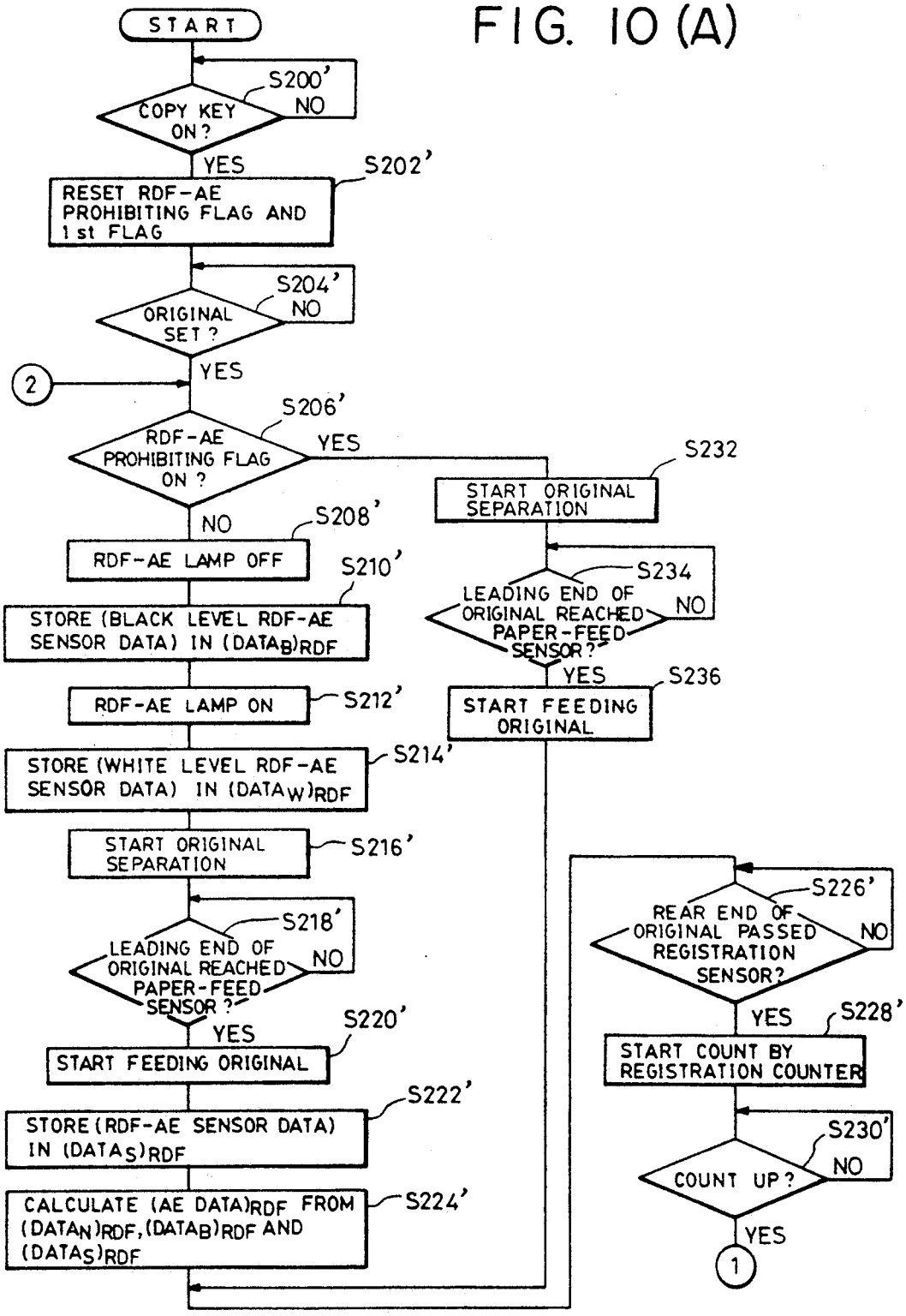
FIGS. 10(A) and 10(B) are flowcharts showing the operation of a third embodiment of the present invention.
Figure 10B:
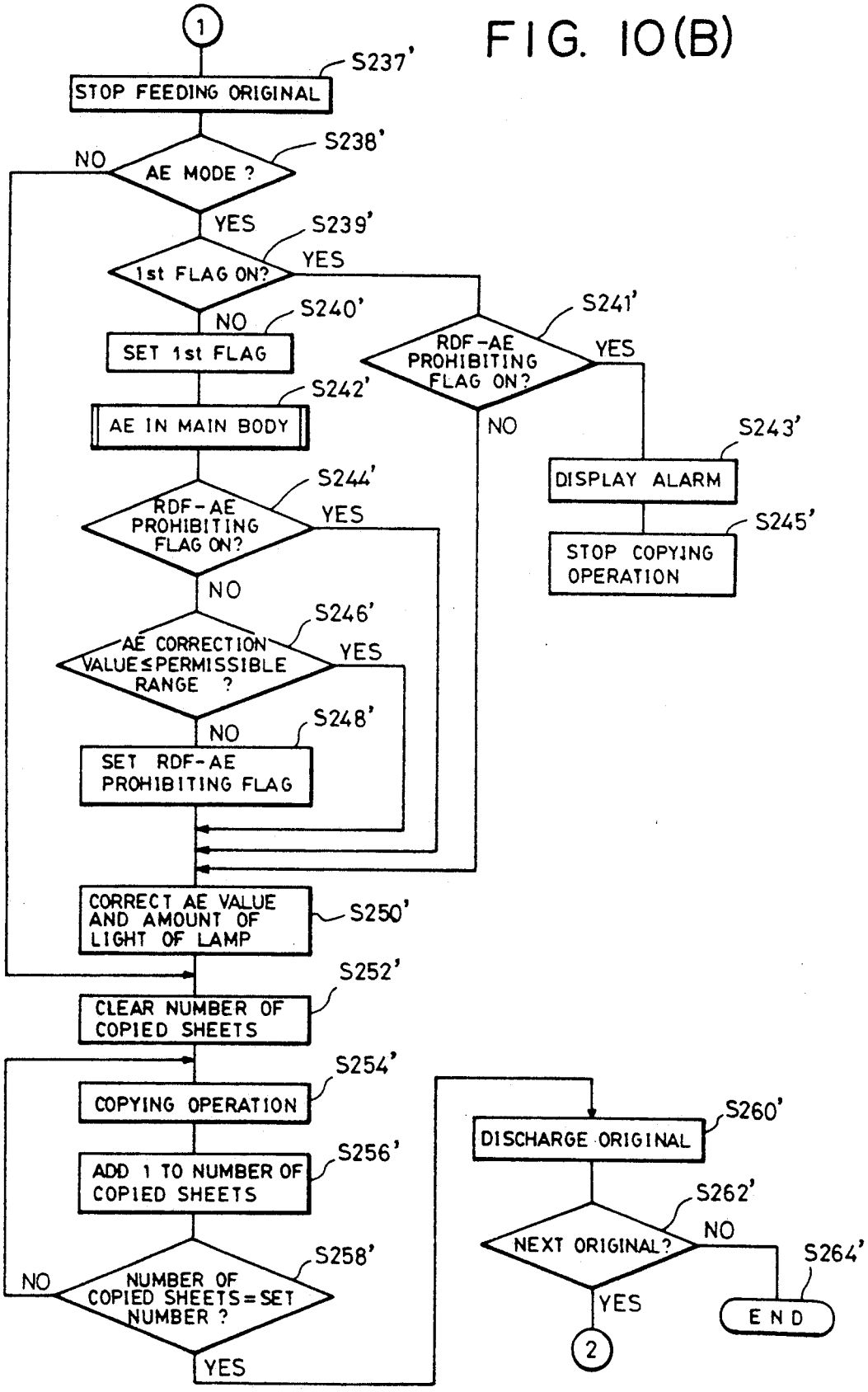

The flowcharts of FIGS. 10(A) and 10(B) show a control procedure in still another (third) embodiment of the present invention.

The present embodiment is an example wherein the present invention is applied to an image recording apparatus including a recycle-type original (document) feeder (RDF). The basic configuration of the apparatus is identical to that of the first embodiment.

The control procedure of the present embodiment shown in FIGS. 10(A) and 10(B) differs from the control procedure of the second embodiment in the following item. That is, when the CPU 301 determines that the RDF-AE prohibiting flag is turned on at step S241' which is identical to step S241 of the second embodiment shown in FIGS. 9(A) and 9(B), alarm display is performed (step S243'), and the copying operation is stopped (step S245'). Other items are the same as in the control procedure shown in FIGS. 9(A) and 9(B). That is, steps S200–S264 shown in FIGS. 9(A) and 9(B) correspond to steps S200'–S264' shown in FIGS. 10(A) and 10(B). Accordingly, in the present embodiment, it is possible to promptly know a failure in the AE sensor 25-2, and to perform effective maintenance.

The flowcharts of FIGS. 10(A) and 10(B) will now be explained in detail.

First, at step S200', the CPU 301 determines whether or not the copy start key on the operation unit has been depressed. If the CPU 301 has determined that the copy start key was depressed at step S200', at the next step S202', the CPU 301 for controlling the operation of respective components initializes (resets) flags (the RDF-AE prohibiting flag and 1st flag) provided in the RAM 302-2. Next, at step S204', the CPU 301 checks whether or not the bundle of originals has been set on the original tray 1 on the RDF 200 according to an output from the sensor 20. If the result of check is affirmative, the CPU 301 determines whether or not the RDF-AE flag has been set. If the result of determination is affirmative, the process proceeds to step S232', which will be described later. If the result is negative, initial data collection by the RDF-AE sensor 25-2 from the next step S208' until step S214' is performed. That is, at step S208', the AE lamp 25-1 is turned off. At step S210', output data (RDF-AE sensor data) from the RDF-AE sensor 25-2 at that time are stored in data area $(DATA_B)_{RDF}$ in the RAM 302-2. The stored data serve as data for the black level. Subsequently, at step S212', the RDF-AE lamp 25-1 is turned on. At step S214', AE sensor data at that time are stored in data area $(DATA_W)_{RDF}$ in the RAM 302-2. At that time, by reading the white plate 24 facing the RDF-AE sensor 25-2, data for the white level are stored in the $(DATA_W)_{RDF}$.

Next, at step S216', the separation operation of originals is started by driving the paper-feed belt 3 and the like, wherein originals are separated one by one starting from the lowest original. When the leading end of the original has reached the paper-feed sensor 13 at step S218', the feed operation of the original is started at step S220'.

At the same time, the RDF-AE lamp 25-1 is turned on. At step S222', data of the RDF-AE sensor 25-2 at that time, that is, RDF-AE sensor data corresponding to the density of the original, are stored in data area $(DATA_S)_{RDF}$ in the RAM 302-2. Although only one point is sampled in the present embodiment, it is possible to increase accuracy by sampling a plurality of points and calculating the average value of the points.

Subsequently, at step S224', $(\text{AE data})_{RDF}$ is calculated using respective data $(DATA_W)_{RDF}$, $(DATA_B)_{RDF}$ and $(DATA_S)_{RDF}$ sequentially stored in the RAM 302-2. If, for example, $(DATA_S)_{RDF}=2.5$ V when $(DATA_W)_{RDF}1.0$ V and $(DATA_B)_{RDF}=4.2$ V, the density is $(2.5-1.0)/(4.2-1.0)=47\%$.

Subsequently, after waiting until the rear end of the original passes through the paper-feed registration sensor 14 at step S226', a counting operation by the registration counter is started at step S228'. After counting belt clock pulses by the registration counter and waiting until the count value reaches a predetermined value at step S230', the feed of the original is stopped at step S237', and the original is stopped at a predetermined position on the platen glass 101.

Subsequently, at step S238', the CPU 301 determines whether or not an AE mode has been set. If the result of determination is negative, the process proceeds to step S252', which will be described later.

If the result of determination is affirmative, the process proceeds to step S239'. If the 1st flag is turned off, the 1st flag is set at step S240', and processing of AE in the main body is performed at step S242'. The processing of AE in the main body at step S242' is performed in the same manner as the processing in the first embodiment shown in FIG. 8.

If the 1st has been turned on at step S239', the process proceeds to step S241', from where the process proceeds to step S252' or step S243' if the RDF-AE prohibiting flag is turned off or on, respectively.

Subsequently, at step S244', the CPU 301 determines whether or not the above-described flag (RDF-AE prohibiting flag) in the RAM 302-2 has been set. If the result of determination is affirmative, the process proceeds to step S250'. If the result of determination is negative, the CPU 301 determines whether or not the AE correction value calculated at step S242' is within a preset permissible range at step S246'. If the result of determination is negative, the flag (RDF-AE prohibiting flag) in the RAM 302-2 is set at step S248'. Subsequently, at step S250', the correction of the proper AE value and the correction of the proper amount of light of the lamp are performed using three kinds of information: the RDF-AE value, the main-body AE value and the RDF-AE prohibiting flag.

At step S243', since the difference between the RDF-AE value and the main-body AE value exceeds the predetermined permissible range, the CPU 301 determines that the AE sensor 25-2 in the RDF 200 cannot be used, and displays the incapability of the use of the AE sensor 25-2 on a display unit (not shown) on a the operation unit, thereby indicating the incapability of the use of the AE mode using the RDF 200. Subsequently, the copying operation is stopped at step S245'.

At step S252', the number of sheets on which images have been copied is cleared. At step S254', a one-cycle copying operation is performed. Subsequently, the number of sheets on which images have been copied is incremented by 1 at step S256'. At step S258', the CPU 301 determines whether or not the number of sheets on which images have been copied is equal to a preset number. If the result of determination is negative, the process proceeds to step S254'. If the result of determination is affirmative, the original is discharged at step S260'. Subsequently, at step S262', the presence of the next original is determined. If the next original is present, the process proceeds to step S206', where the same processing as described above is performed. If the next original is absent, the process is terminated at step S264'.

As in the first embodiment, when performing a copying operation without using the RDF 200, the density of the original is detected in the main body 100.

Also in the above-described second embodiment as in the third embodiment, when the AE correction value exceeds a permissible range, an alarm may be displayed on a display unit on the operation unit.

The present invention is not limited to the above-described embodiments, but various changes and modifications may be made within the true spirit and scope of the following claims.

What is claimed is:

1. An image processing apparatus comprising:

an original feed unit having an original feed path for feeding an original to an exposure position;

a first detector provided in said original feed path for detecting a density of the original being fed;

an exposure member for exposing the original at said exposure position;

a second detector for detecting the density of the original at said exposure position; and control means for controlling processing conditions for an image of the original exposed by said exposure unit according to at least one output from said first detector and said second detector, wherein said control means controls a density of reproduction of the original.

2. An image processing apparatus according to claim 1, wherein said control means controls an amount of light when exposing the original by said exposure unit.

3. An image processing apparatus according to claim 1, wherein said first detector is responsive to said control means such that said first detector detects the density of the original when the original is set to the exposure position using said original feed unit, and wherein said second detector is responsive to said control means such that said second detector detects the density of the original when the original is manually set to the exposure position without using said original feed unit.

4. An image processing apparatus according to claim 1, wherein said exposure unit is responsive to said control means such that said exposure unit prescans the original when said second detector detects the density of the original.

5. An image processing apparatus comprising:

an original feed unit having an original feed path for feeding an original to an exposure position;

a first detector provided in said original feed path for detecting a density of the original being fed;

an exposure unit for exposing the original at said exposure position;

a second detector for detecting the density of the original at the exposure position;

correction means for obtaining and storing correction data to correct output data from said first detector according to output data from said second detector; and control means for controlling processing conditions for an image of the original exposed by said exposure unit according to said correction data and the output data from said first detector.

6. An image processing apparatus according to claim 5, wherein said control means controls image processing conditions of a first original fed by said original feed means according to the output data from said second detector, wherein said control means obtains the correction data in accordance with said correction means, wherein said control means stores the correction data, and wherein said control means controls image processing conditions of a second original according to the correction data and the output data from said first detector.

7. An image processing apparatus according to claim 5, wherein said correction means stores the obtained correction data until exposure of all originals mounted on said original feed unit is completed.

8. An image processing apparatus according to claim 5, wherein said control means controls an amount of light when exposing the original by said exposure unit.

9. An image processing apparatus according to claim 5, wherein said control means controls a density of reproduction of the original.

10. An image processing apparatus comprising:

an original feed unit having an original feed path for feeding an original to an exposure position;

a first detector provided in said original feed path for detecting a density of the original being fed;

an exposure unit for exposing the original at said exposure position;

a second detector for detecting the density of the original at the exposure position;

correction means for obtaining and storing correction data to correct output data from said first detector according to output data from said second detector; and control means for controlling processing conditions for an image of the original exposed by said exposure unit according to said correction data and the output data from said first detector when a value of the correction data obtained by said correction means is within a predetermined range, and for controlling processing conditions for the image of the original exposed by said exposure unit according to the output data from said second detector when the value of the correction data obtained by said correction means is outside of the predetermined range.

11. An image processing apparatus according to claim 10, wherein said correction means is responsive to said control means such that said correction means obtains the correction data using a first fed original among a plurality of originals mounted on said original feed unit.

12. An image processing apparatus according to claim 11, wherein said control means controls image processing conditions according to the output data from said second detector for said first original.

13. An image processing apparatus according to claim 10, wherein, said control means displays an indication if the value of said correction data is outside the predetermined range.

14. An image processing apparatus according to claim 10, wherein said control means controls an amount of light when exposing the original by said exposure unit.

15. An image processing apparatus according to claim 10, wherein said control means controls a density of reproduction of the original.

16. An image processing apparatus comprising:

an original feed unit for feeding an original to an exposure position;

a first detector provided in an original feed path of said original feed unit for detecting a density of the original being fed;

an exposure unit for exposing the original at said exposure position;

a second detector for detecting the density of the original at the exposure position;

correction means for obtaining and storing correction data to correct output data from said first detector according to output data from said second detector; and control means for controlling processing conditions for an image of the original exposed by said exposure unit according to said correction data and the output data from said first detector, when a value of the correction data obtained by said correction means is within a predetermined range, and for prohibiting exposure of the original mounted on said original feed unit, when the value of the correction data obtained by said correction means is outside of the predetermined range.

17. An image processing apparatus according to claim 16, wherein said correction means is responsive to said control means such that said correction means obtains the correction data using a first fed original among a plurality of originals mounted on said original feed unit.

18. An image processing apparatus according to claim 16, wherein said control means displays an indication if the value of said correction data is outside the predetermined range.

19. An image processing apparatus according to claim 16, wherein said control means controls an amount of light when exposing the original by said exposure unit.

20. An image processing apparatus according to claim 16, wherein said control means controls a density of reproduction of the original.

* * * * *

UNITED STATES PATENT AND TRADEMARK OFFICE

CERTIFICATE OF CORRECTION

PATENT NO. : 5,282,000 Page 1 of 2

DATED : January 25, 1994

INVENTOR(S) : Miyake et al.

It is certified that error appears in the above-indentified patent and that said Letters Patent is hereby corrected as shown below: Title page, item:

[30] Foreign Application Priority Data:

"Mar. 5, 1990 [JP] Japan ..... 2-5643" should read --March 5, 1990 [JP] Japan ..... 2-51643--.

COLUMN 3:

Line 2, after "on the" insert --original feed unit when the value of the--.

COLUMN 14:

Line 24, "$(DATA_w)_{RDF}$1.0 V" should read --$(DATA_w)_{RDF}$=1.0 V--; and
Line 46, "1st" should read --1st flag.--

COLUMN 15:

Line 2, delete "a" (second occurrence).

UNITED STATES PATENT AND TRADEMARK OFFICE

CERTIFICATE OF CORRECTION

PATENT NO. : 5,282,000

DATED : January 25, 1994

INVENTOR(S) : Miyake et al.

It is certified that error appears in the above-indentified patent and that said Letters Patent is hereby corrected as shown below:

COLUMN 17:

Line 4, "wherein," should read --wherein--.

Signed and Sealed this

Thirteenth Day of December, 1994

Bruce Lehman

*Attest:*

BRUCE LEHMAN

*Attesting Officer*

*Commissioner of Patents and Trademarks*